US012560385B2

(12) United States Patent
Sievers et al.

(10) Patent No.: US 12,560,385 B2
(45) Date of Patent: Feb. 24, 2026

(54) HEAT EXCHANGER

(71) Applicant: MAHLE International GmbH, Stuttgart (DE)

(72) Inventors: Martin Sievers, Kernen im Remstal (DE); Uwe Foerster, Erdmannhausen (DE); Hicham Rouhana, Korntal-Muenchingen (DE)

(73) Assignee: Mahle International GmbH, Stuttgart (DE)

( * ) Notice: Subject to any disclaimer, the term of this patent is extended or adjusted under 35 U.S.C. 154(b) by 170 days.

(21) Appl. No.: 18/381,628

(22) Filed: Oct. 18, 2023

(65) Prior Publication Data

US 2024/0133633 A1 Apr. 25, 2024
US 2024/0230236 A9 Jul. 11, 2024

(30) Foreign Application Priority Data

Oct. 19, 2022 (DE) ..... 10 2022 211 047.1

(51) Int. Cl.
*F28D 1/053* (2006.01)
*F25B 13/00* (2006.01)
(Continued)

(52) U.S. Cl.
CPC ..... *F28D 1/05391* (2013.01); *F25B 13/00* (2013.01); *F25B 39/04* (2013.01); *F28D 9/005* (2013.01)

(58) Field of Classification Search
CPC ..... F28D 1/05391; F28D 9/00; F28D 9/005; F28D 9/0037; F28D 9/0056;
(Continued)

(56) References Cited

U.S. PATENT DOCUMENTS 9,927,158 B2 * 3/2018 Martin ..... F28F 9/0246
10,408,543 B2 * 9/2019 Barfknecht ..... F25B 39/04
2015/0226469 A1 * 8/2015 Hofmann ..... F28D 9/00 62/506

FOREIGN PATENT DOCUMENTS

DE 102011078136 A1 12/2012
DE 102012220594 A1 3/2014
(Continued)

*Primary Examiner* — Len Tran
*Assistant Examiner* — Kamran Tavakoldavani
(74) *Attorney, Agent, or Firm* — Muncy, Geissler, Olds & Lowe, P.C.

(57) ABSTRACT

A heat exchanger including a heat exchanger block having first fluid channels and second fluid channels, including a fluid collector, the first fluid channels having a first fluid channel section and a second fluid channel section. A first fluid inlet is provided, which is fluidically connected to the first fluid channel section of the first fluid channels. A first fluid outlet is fluidically connected to the first fluid channel section of the first fluid channels. A second fluid inlet is fluidically connected to the second fluid channel section of the first fluid channels. A second fluid outlet is fluidically connected to the second fluid channel section of the first fluid channels. The fluid collector has a third fluid inlet, a third fluid outlet, and a fourth fluid inlet, which is fluidically connected to the second fluid channels. A fourth fluid outlet is fluidically connected to the second fluid channels.

14 Claims, 2 Drawing Sheets

(51) Int. Cl.
*F25B 39/04* (2006.01)
*F28D 9/00* (2006.01)

(58) Field of Classification Search
CPC .. F28D 2021/0084; F25B 13/00; F25B 39/04; F25B 2339/044; F25B 2339/047; F25B 2339/043; F25B 2339/0442; F28F 9/22; F28F 9/26; F28F 2280/00; F28F 2280/06; F28F 19/01
See application file for complete search history.

(56) References Cited

FOREIGN PATENT DOCUMENTS

| | | | |
|---|---|---|---|
| DE | 102013214695 | A1 | 1/2015 |
| DE | 102019210022 | A1 | 1/2021 |

* cited by examiner

HEAT EXCHANGER

This nonprovisional application claims priority under 35 U.S.C. § 119(a) to German Patent Application No. 10 2022 211 047.1, which was filed in Germany on Oct. 19, 2023, and which is herein incorporated by reference.

BACKGROUND OF THE INVENTION

Field of the Invention

The invention relates to a heat exchanger, in particular a condenser, preferably for a refrigerant circuit and for a coolant circuit of a motor vehicle.

Description of the Background Art

Heat exchangers, in particular condensers, for motor vehicles are known in different designs in the prior art.

Air-cooled condensers are known, which have a relatively large size, due to the large planar tube/rib block for the through-flow of the air. Condensers of this type are typically arranged at the front of the motor vehicle and are situated in the direct air flow flowing against the motor vehicle. A small size and an individual placement within the vehicle are therefore not possible.

In the case of coolant-cooled condensers, the size is much more compact, and they may therefore by conveniently placed in a released installation space. However, the arrangement of the connections for fitting into the installation space is crucial, so that the provided fluid connections for the refrigerant as well as for the coolant may be designed so as to be compact and precisely fitting, the internal connection and the internal fluid channel profiles also being important for the heat transfer efficiency of the heat exchanger.

SUMMARY OF THE INVENTION

It is therefore an object of the invention to provide a heat exchanger, in particular a condenser, which has a compact design and requires little installation space and nevertheless has an improved heat transfer efficiency.

In an exemplary embodiment of the invention a heat exchanger is provided, in particular a condenser, which includes a heat exchanger block having a multiplicity of first fluid channels for a refrigerant and having a multiplicity of second fluid channels for a liquid coolant, the first fluid channels and the second fluid channels being thermally connected to each other, including a fluid collector, the first fluid channels having a first fluid channel section and a second fluid channel section, a first fluid inlet for the refrigerant being provided, which is fluidically connected to the first fluid channel section of the first fluid channels, a first fluid outlet for the refrigerant being provided, which is fluidically connected to the first fluid channel section of the first fluid channels, a second fluid inlet for the refrigerant being provided, which is fluidically connected to the second fluid channel section of the first fluid channels, a second fluid outlet for the refrigerant being provided, which is fluidically connected to the second fluid channel section of the first fluid channels, the fluid collector having a third fluid inlet for the refrigerant and a third fluid outlet for the refrigerant, and a fourth fluid inlet for the liquid coolant being provided, which is fluidically connected to the second fluid channels, and a fourth fluid outlet for the liquid coolant being provided, which is fluidically connected to the second fluid channels, the first fluid outlet being fluidically connected to the third fluid inlet, and the third fluid outlet being fluidically connected to the second fluid inlet. This achieves the fact that a good heat transfer efficiency is reached with a compact design, and an improvement of the supercooling of the refrigerant in the second fluid channel section of the first fluid channel is achieved as the supercooling area with the aid of the fluid collector. The first fluid channel section of the first fluid channel is used for desuperheating and condensation of the refrigerant and may likewise be provided with a design optimized to the conditions of density increase of the refrigerant, so that, in this regard as well, an improved desuperheating and condensation takes place with the same installation space, or the necessary installation space for the heat exchanger block may be reduced while maintaining the same desuperheating and condensation. For example, the size of the heat exchanger block may be reduced thereby.

The heat exchanger block can be made up of a multiplicity of heat exchanger plates, which are stacked one on top of the other and which form the first fluid channels having at least the first fluid channel section and the second fluid channel section as well as forming the second fluid channels. A compact heat exchanger block may thus be economically provided, the first fluid channel section of the first fluid channels and the second fluid channel section of the first fluid channels as well as the second fluid channels being able to be configured according to the specific requirements, in particular with regard to the flow cross section. The particular flow velocity of the refrigerant or the liquid coolant as well as the related pressure drop may be specifically selected.

The first fluid channel section of the first fluid channels can have at least one first passage and a second passage, the first passage and the second passage being serially interconnected and thus allowing serial through-flow. The two fluid channels of the first fluid channel section can be divided thereby into at least two passages for the desuperheating and condensation in order to achieve a favorable heat transfer between the refrigerant and the liquid coolant in the second fluid channels. An adaptation with regard to the density and the flow velocity of the refrigerant may be achieved thereby.

The first passage of the first fluid channel section can have a larger flow cross section than the second passage of the first fluid channel section and/or than the second fluid channel section. An adaptation to the density and the flow velocity of the refrigerant may be achieved thereby.

The second passage of the first fluid channel section can have a larger flow cross section than the second fluid channel section. An adaptation for a condensing area having gaseous and liquid refrigerant and for a supercooling area for liquid refrigerant likewise being carried out thereby.

The first passage of the first fluid channel section of the first fluid channels can allow through-flow in the counter-current flow to the second fluid channels, and/or the second fluid channel section of the first fluid channels can allow through-flow in the counter-current flow to the second fluid channels, and/or the second passage of the first fluid channel section can allow through-flow in the co-current flow to the second fluid channels. An effective heat transfer takes place thereby, in particular in the desuperheating area and in the supercooling area, at which greater temperature reductions of the refrigerant are achieved in contrast to the condensing area, in which the temperature of the refrigerant remains relatively constant.

The fluid collector can include a tubular housing, which, on a side surface, has the third fluid inlet for the refrigerant for the purpose of inflow into the fluid collector and the third fluid outlet for the refrigerant for the purpose of outflow from the fluid collector. As a result, the fluid collector may be connected to the heat exchanger block in a space-saving manner, and a fluid connection may take place without additional tubing, which saves installation space and costs.

A fluid conducting element having two fluid connecting channels can be arranged between the heat exchanger block and the fluid collector, a first fluid connecting channel forming a fluid connection between the first fluid outlet and the third fluid inlet, and a second fluid connecting channel forming a fluid connection between the third fluid outlet and the second fluid inlet. A fluid connection between the heat exchanger block and the fluid collector may be implemented thereby in a particularly space-saving manner, and a diversion of the fluid connection in the direction of another installation height may take place at the same time, so that the fluid inlets or fluid outlets to be connected do not have to be situated directly opposite each other.

The fluid conducting element can be designed as a plate having two grooves, the plate being arranged between the heat exchanger block and the housing of the fluid collector, and the two grooves in the plate of the fluid conducting element forming the first fluid connecting channel and the second fluid connecting channel. A connection of the fluid collector to the heat exchanger block may take place thereby in an easy and installation space-saving manner.

The fluid collector can be arranged and fastened with its housing on the heat exchanger block such that it extends only over a first subarea of the extension of the heat exchanger block and leaves a second subarea of the heat exchanger block free, a fluid inlet and/or a fluid outlet being provided, in particular, in the second subarea, in particular the fourth fluid inlet for the coolant and/or the second fluid outlet for the refrigerant. A favorable and installation space-saving connection of the heat exchanger to at least one fluid circuit or to both fluid circuits for refrigerant or liquid coolant may thus take place.

The heat exchanger block and/or the heat exchanger plates can have an essentially rectangular basic shape, a width of the heat exchanger plates and/or the heat exchanger block being in a range from 75 mm to 85 mm, in particular 80 mm, and/or a length of the heat exchanger plates and/or the heat exchanger block being in a range from 170 mm to 185 mm, in particular 183 mm. This represents a significant reduction in the dimensions of the heat exchanger block or the heat exchanger plates, compared to the prior art, and is used for a significant reduction of the installation space. This may be achieved in that the design of the heat exchanger, including its fluid guidance, results in a much higher heat transfer efficiency, which nevertheless sufficiently achieves heat transfer capacity in a reduced installation space.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
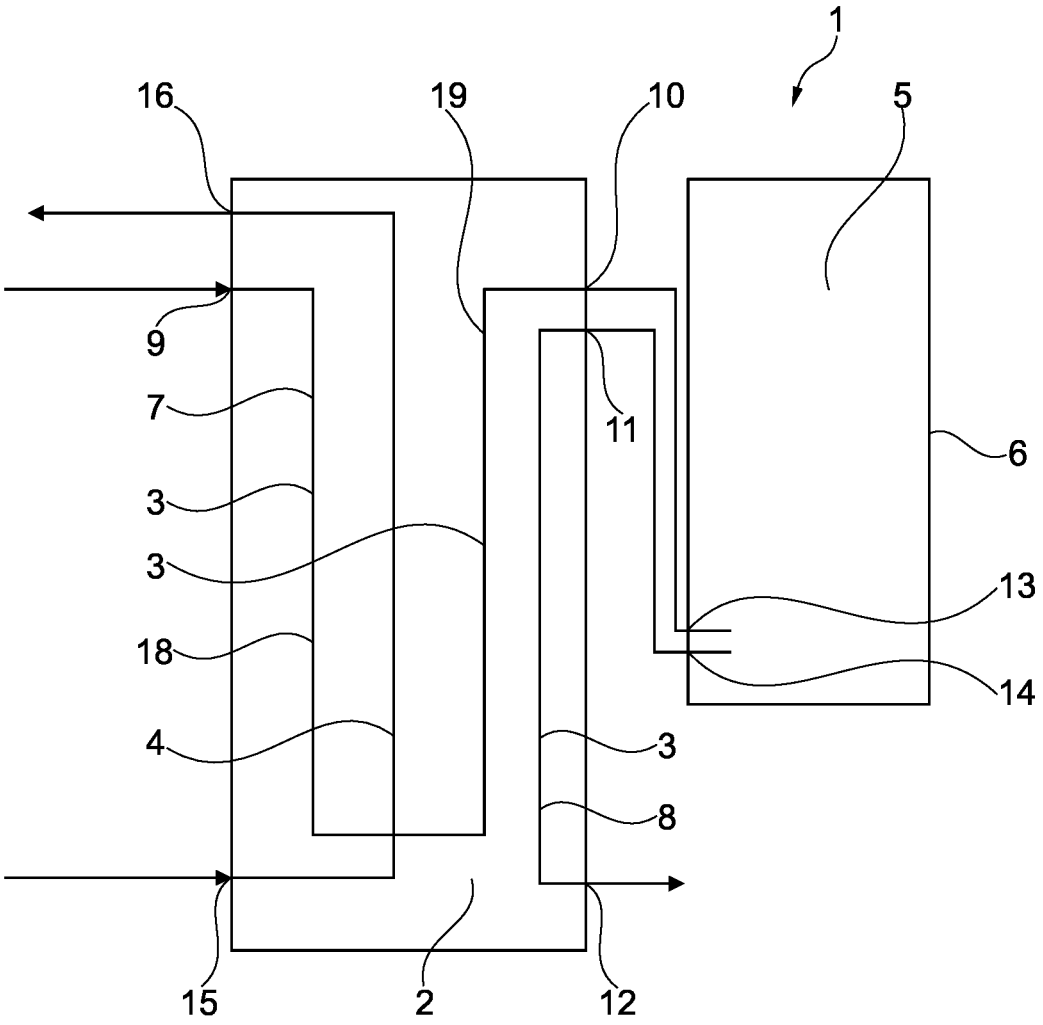
FIG. 1 shows a schematic representation of an example of a fluid collector according to the invention.
Figure 2:
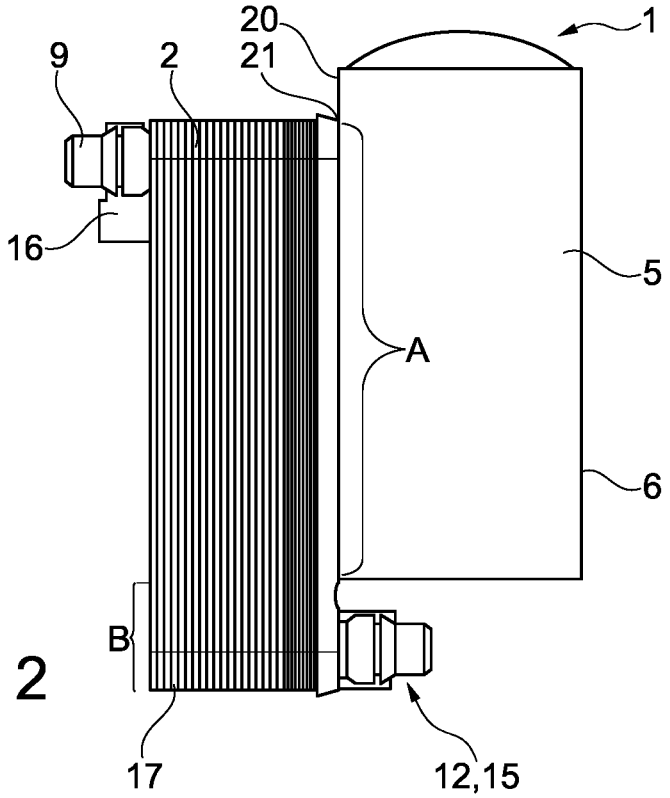
FIG. 2 shows a schematic representation of an example of a heat exchanger according to the invention.
Figure 3:
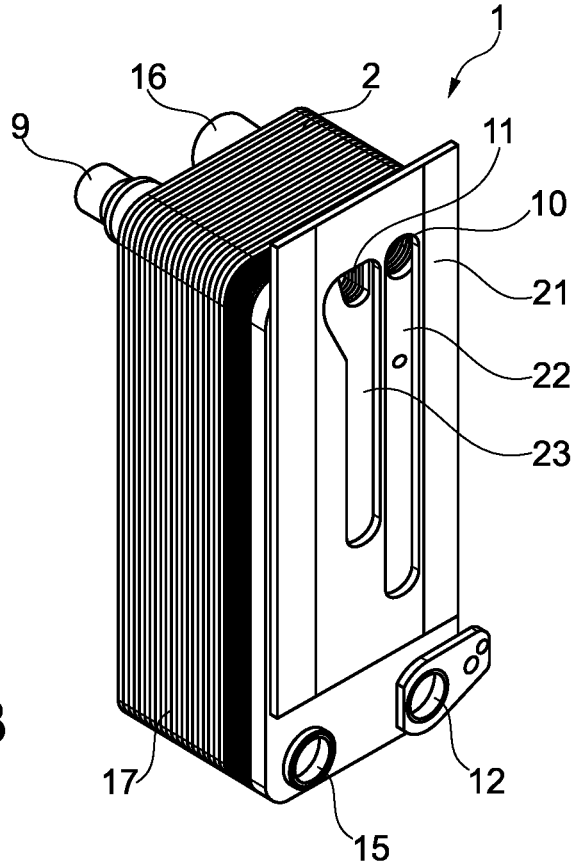
FIG. 3 shows a further schematic partial representation of an example of the heat exchanger according to the invention.

The invention relates to a heat exchange 1, in particular a condenser, in particular for a motor vehicle. Heat exchanger 1 is fluidically integrated into a refrigerant circuit, on the one hand, and into a circuit of liquid coolant, on the other hand, so that a heat transfer from the refrigerant to the liquid coolant may take place in heat exchanger 1 for the purpose of cooling the refrigerant with the aid of the liquid coolant. For this purpose, FIGS. 1 through 3 show different representations of examples of a heat exchanger 1 of this type.

The liquid coolant is, for example, water or a water mixture, a glycol/water mixture, etc. The refrigerant is, for example, R1234yf or R134a, R744, etc.

Heat exchanger 1 according to the invention, such as, for example, a condenser, includes a heat exchanger block 2 having a multiplicity of first fluid channels 3 for the refrigerant and having a multiplicity of second fluid channels 4 for the liquid coolant. First fluid channels 3 for the refrigerant are designed and/or arranged, for example, in parallel to each other and/or serially with respect to each other. Second fluid channels 4 for the liquid coolant are preferably designed and/or arranged, for example, in parallel to each other and/or serially with respect to each other.

First fluid channels 3 and second fluid channels 4 are arranged thermally connected to each other in an upright manner. First fluid channels 3 and second fluid channels 4 advantageously alternate, so that a good thermal contact for the heat transfer is present.

A fluid collector 5 is furthermore provided for the refrigerant. Fluid collector 5 includes a tubular housing 6, which defines an interior for collecting liquid refrigerant, degassing the liquid refrigerant, and optionally dehumidifying and/or filtering the refrigerant with the aid of filters and/or dryers.

Fluid collector 5 is preferably connected to heat exchanger block 2 adjacent to this heat exchanger block 2 for the purpose of forming a structural unit.

According to FIG. 1, first fluid channels 3 have at least one first fluid channel section 7 and a second fluid channel section 8, which are arranged in heat exchanger block 2.

A first fluid inlet 9 for the refrigerant is furthermore provided, which is fluidically connected to first fluid channel section 7 of first fluid channels 3. A first fluid outlet 10 for the refrigerant is also provided, which is fluidically connected to first fluid channel section 7 of first fluid channels 3. First fluid channel section 7 of first fluid channels 3 connects first fluid inlet 9 to first fluid outlet 10.

A second fluid inlet 11 for the refrigerant is provided, which is fluidically connected to second fluid channel section 8 of first fluid channels 3. A second fluid outlet 12 for the refrigerant is furthermore provided, which is fluidically connected to second fluid channel section 8 of first fluid channels 3. Second fluid channel section 8 of first fluid channels 3 connects second fluid inlet 11 to second fluid outlet 12.

Fluid collector 5 has a third fluid inlet 13 for the refrigerant and a third fluid outlet 14 for the refrigerant. Refrigerant may thus flow into fluid collector 5 through third fluid inlet 13 and flow out of fluid collector 5 through third fluid outlet 14.

According to FIG. 1, heat exchanger block 2 and fluid collector 5 are fluidically connected to each other in such a way that the refrigerant flows into first fluid channel section 7 of first fluid channels 3 through first fluid inlet 9, flows through first fluid channels 3 of first fluid channel section 7, and leaves heat exchanger block 2 at first fluid outlet 10.

The refrigerant flows from first fluid output 10 through third fluid inlet 13 into fluid collector 5, flows through fluid collector 5, and flows out of fluid collector 5 at third fluid outlet 14.

The refrigerant flows from third fluid outlet 14 to second fluid inlet 11 of heat exchanger block 2 and flows through second fluid inlet 11 into second fluid channel section 8 of first fluid channels 3, first fluid channels 3 of second fluid channel section 8 subsequently being passed through, and the refrigerant leaving heat exchanger block 2 at second fluid outlet 12. First fluid outlet 10 is thus fluidically connected to third fluid inlet 13, and third fluid outlet 14 is fluidically connected to second fluid inlet 11.

Heat exchanger block 2 further has a fourth fluid inlet 15 for the liquid coolant, which is fluidically connected to second fluid channels 4. A fourth fluid outlet 16 for the liquid coolant is also provided, which is fluidically connected to second fluid channels 4.

It is apparent from FIGS. 2 and 3 that heat exchanger block 2 is made up of a multiplicity of heat exchanger plates 17, which are stacked one on top of the other and which form first fluid channels 3 having at least the fluid channel section 7 and second fluid channel section 8 as well as forming second fluid channels 4. Heat exchanger plates 17 typically have openings for fluid overflow, boundaries also being provided to prevent a mixing of different fluids and to separate particular fluid channels 3, 4.

It is also apparent in FIG. 1 that first fluid channel section 7 of first fluid channel 3 has at least one first passage 18 and a second passage 19, first passage 18 and second passage 19 being serially interconnected and thus allowing serial through-flow. A particular passage is a part of first fluid channel section 7, in which the refrigerant flows through third fluid channels 3.

First passage 18 is used for the desuperheating and optionally proportional condensation of the inflowing gaseous or vaporous refrigerant, and second passage 19 is used for the complete condensation of the previously desuperheated refrigerant.

The first passage 18 of first fluid channel section 7 can have a larger flow cross section than second passage 19 of first fluid channel section 7 and/or than second fluid channel section 8. This is advantageous because the gaseous or vaporous refrigerant requires more space than the already partially condensed or completely condensed refrigerant.

The second passage 19 of first fluid channel section 7 can have a larger flow cross section than second fluid channel section 8.

To particularly effectively cool the refrigerant in first fluid channels 3, it is also expedient if first passage 18 of first fluid channel section 7 of first fluid channels 3 allows through-flow in the counter-current flow to second fluid channels 4, cf. FIG. 1, and/or that second fluid channel section 8 of first fluid channels 3 allows through-flow in the counter-current flow to second fluid channels 4, cf. FIG. 1, and/or second passage 19 of first fluid channel section 7 of first fluid channels 3 allows through-flow in the co-current flow to second fluid channels 4. The counter-current flow between the refrigerant and liquid coolant may be used thereby, in particular if a temperature reduction of the refrigerant occurs in the particular heat transfer situation.

Fluid collector 5 described above includes an essentially tubular housing 6, which is closed at its axial end areas. On one side surface 20, housing 6 has third fluid inlet 13 for the refrigerant and third fluid outlet 14 for the refrigerant.

A fluid conducting element 21, including two fluid connecting channels 22, 23, is arranged between heat exchanger block 2 and fluid collector 5, as is apparent in FIG. 3. A first fluid connecting channel 22 forms a fluid connection between first fluid outlet 10 and third fluid inlet 13, and a second fluid connecting channel 23 forms a fluid connection between third fluid outlet 14 and second fluid inlet 11.

Fluid conducting element 21 is advantageously designed as a plate having two grooves, the plate being arranged between heat exchanger block 2 and housing 6 of fluid collector 5, and the two grooves in the plate of fluid conducting element 21 forming first fluid connecting channel 22 and second fluid connecting channel 23.

Fluid conducting element 21 as a plate may, in principle, be designed as a separate component, which is arranged between heat exchanger block 2 and fluid collector 5 and is fastened thereto.

Alternatively, fluid conducting element 21 also as a plate may be designed as an extruded component, which is provided as a single piece on fluid collector 5 and is advantageously manufactured to form a single piece with fluid collector 5 by extrusion or by another manufacturing process.

The plate of fluid conducting element 21 may, in principle, be designed as a single piece on fluid collector 5, even on a fluid collector 5 having a round cross section.

It is furthermore apparent from FIG. 2 that fluid collector 5 is arranged and fastened with its housing 6 on heat exchanger block 2 in such a way that it extends only over a first subarea A of the extension of heat exchanger block 2 and leaves a second subarea B of heat exchanger block 2 free, a fluid inlet 15 and/or a fluid outlet 12 being provided, in particular, in second subarea B, in particular fourth fluid inlet 15 for the coolant and/or second fluid outlet 12 for the refrigerant, as illustrated in FIGS. 2 and. 3.

Due to the improved efficiency of the heat transfer, heat exchanger block 2 and heat exchanger plates 17 may be provided with a space-saving design, so that heat exchanger block 2 and/or heat exchanger plates 17 may have an essentially rectangular basic shape, a width of heat exchanger plates 17 and/or heat exchanger block 2 being in a range from 75 mm to 85 mm, in particular 80 mm, and/or a length of heat exchanger plates 17 and/or heat exchanger block 2 being in a range from 170 mm to 185 mm, in particular 183 mm.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

a heat exchanger block having a plurality of first fluid channels for a refrigerant and a plurality of second fluid channels for a liquid coolant, the first fluid channels and the second fluid channels being thermally connected to each other; and a fluid collector, wherein the first fluid channels have a first fluid channel section and a second fluid channel section, wherein a first fluid inlet for the refrigerant is fluidically connected to the first fluid channel section of the first fluid channels, wherein a first fluid outlet for the refrigerant is fluidically connected to the first fluid channel section of the first fluid channels, wherein a second fluid inlet for the refrigerant is fluidically connected to the second fluid channel section of the first fluid channels, wherein a second fluid outlet for the refrigerant is fluidically connected to the second fluid channel section of the first fluid channels, wherein the fluid collector has a third fluid inlet for the refrigerant and a third fluid outlet for the refrigerant, and wherein a fourth fluid inlet for the liquid coolant is fluidically connected to the second fluid channels, wherein a fourth fluid outlet for the liquid coolant is fluidically connected to the second fluid channels, wherein the first fluid outlet is fluidically connected to the third fluid inlet, wherein the third fluid outlet is fluidically connected to the second fluid inlet, and wherein the first fluid channel section of the first fluid channels has a first passage and a second passage, the first passage and the second passage being serially interconnected and thus allowing serial through-flow.

2. The heat exchanger according to claim 1, wherein the heat exchanger block is made up of a plurality of heat exchanger plates, which are stacked one on top of the other and which form the first fluid channels having at least the first fluid channel section and the second fluid channel section, as well as forming the second fluid channels.

3. The heat exchanger according to claim 1, wherein the first passage of the first fluid channel section has a larger flow cross section than the second passage of the first fluid channel section and/or than the second fluid channel section.

4. The heat exchanger according to claim 1, wherein the second passage of the first fluid channel section has a larger flow cross section than the second fluid channel section.

5. The heat exchanger according to claim 1, wherein the first passage of the first fluid channel section of the first fluid channels allows through-flow in the counter-current flow to the second fluid channels, and/or wherein the second fluid channel section of the first fluid channels allows through-flow in the counter-current flow to the second fluid channels, and/or wherein the second passage of the first fluid channel section allows through-flow in the co-current flow to the second fluid channels.

6. The heat exchanger according to claim 1, wherein the fluid collector includes a tubular housing, which has the third fluid inlet for the refrigerant and the third fluid outlet for the refrigerant on one side surface.

7. The heat exchanger according to claim 1, further comprising:

a fluid conducting element, having a first fluid connecting channel and a second fluid connecting channel, is arranged between the heat exchanger block and the fluid collector;

the first fluid connecting channel forming a fluid connection between the first fluid outlet and the third fluid inlet, and the second fluid connecting channel forming a fluid connection between the third fluid outlet and the second fluid inlet.

8. The heat exchanger according to claim 7, wherein the fluid conducting element is designed as a plate having two grooves, the plate being arranged between the heat exchanger block and a housing of the fluid collector, and wherein the two grooves in the plate of the fluid conducting element form the first fluid connecting channel and the second fluid connecting channel.

9. The heat exchanger according to claim 1, wherein a housing of the fluid collector is arranged and fastened on the heat exchanger block such that the housing extends only over a first subarea of an extension of the heat exchanger block and leaves a second subarea of the heat exchanger block free, and wherein the fourth fluid inlet for the coolant and/or the second fluid outlet for the refrigerant is arranged in the second subarea.

10. The heat exchanger according to claim 2, wherein the heat exchanger block and/or the heat exchanger plates have an essentially rectangular basic shape, and wherein a width of the heat exchanger plates and/or the heat exchanger block being in a range from 75 mm to 85 mm, or being 80 mm, and/or a length of the heat exchanger plates and/or the heat exchanger block being in a range from 170 mm to 185 mm, or being 183 mm.

11. The heat exchanger according to claim 1, wherein the heat exchanger is a condenser.

12. The heat exchanger according to claim 1, wherein a housing of the fluid collector is arranged and fastened on the heat exchanger block such that the housing extends only over a first subarea of an extension of the heat exchanger block and leaves a second subarea of the heat exchanger block free, the fourth fluid inlet for the coolant being arranged in the second subarea.

13. The heat exchanger according to claim 12, wherein the fourth fluid outlet for the coolant is arranged in the first subarea.

14. The heat exchanger according to claim 1, wherein the fluid collector includes a tubular housing that is a separate structure from the heat exchanger block and is fastened to the heat exchanger block.

* * * * *